US005130909A

United States Patent [19]

Gross

[11] Patent Number: 5,130,909

[45] Date of Patent: Jul. 14, 1992

[54] EMERGENCY LIGHTING STRIP

[75] Inventor: H. Gerald Gross, Santa Ana, Calif.

[73] Assignee: Wickes Manufacturing Company, Southfield, Mich.

[21] Appl. No.: 687,053

[22] Filed: Apr. 18, 1991

[51] Int. Cl.[5] ..... F21S 1/02

[52] U.S. Cl. ..... 362/153; 362/241; 362/243; 362/245; 362/247; 362/307; 362/800

[58] Field of Search ..... 362/145, 147, 153, 241, 362/243, 245, 255, 247, 249, 252, 800, 307, 310

[56] References Cited

U.S. PATENT DOCUMENTS

| | | | |
|---|---|---|---|
| 4,298,869 | 11/1981 | Okuno | 340/782 |
| 4,347,499 | 8/1982 | Burkman, Sr. et al. | 340/371 |
| 4,376,966 | 3/1983 | Tieszen | 362/249 |
| 4,471,412 | 9/1984 | Mori | 362/310 |
| 4,581,687 | 4/1986 | Nakanishi | 362/800 |
| 4,597,033 | 6/1986 | Meggs et al. | 362/183 |
| 4,682,147 | 7/1987 | Bowman | 340/286 |
| 4,953,066 | 8/1990 | Schiffer | 362/310 |

OTHER PUBLICATIONS

H. Gerald Gross, Wayfinding Lighting Breakthroughs For Smoke In Buildings as Fallout From Aircraft/Ship Programs, May 14–18, 1989.

H. Gerald Gross, A Major Breakthrough In Shipboard Fire Emergency Egress Marking and Lighting for Dense Black Diesel Smoke: Koch Special LED Systems, Dec. 5–8, 1988.

H. Gerald Gross, Space Station Emergency Egress and EVA Lighting Considerations and Candidate Koch Hardware, Nov. 16–19, 1987.

H. Gerald Gross, Koch Emergency Egress Ligthing Systems for Adverse Optical Conditions for Military and Commercial Aircraft and Other Applications, Dec. 11–13, 1986.

H. Gerald Gross, Visibility Threshold Range Observations of LED Emergency Egress Lighting Strips and Signs Through Dense Smoke and Turbid Water, Dec. 1–5, 1985.

H. Gerald Gross, Visibility of an Emergency LED Lighting Strip System Through Smoke and Turbid Water, Nov. 5–81, 1983.

*Primary Examiner*—Ira S. Lazarus
*Assistant Examiner*—Sue Hagarman
*Attorney, Agent, or Firm*—David A. Greenlee

[57] ABSTRACT

An emergency aid, in the form of a lighting strip arranged along the floor of a predetermined escape route, is provided for guiding the escape of occupants from a confined area during conditions of severely reduced visibility. The strip comprises a plurality of spaced light-emitting elements, each being an L.E.D. emitting a beam having an axial intensity of at least 0.12 candela and a full cone angle no greater than 24 degrees. Each element includes an exernal reflector, in the form of a spaced prism or a metal reflector mounted on the element, located along its beam axis and angled with respect thereto for deflecting the emitted light at a predetermined angle. In one embodiment the elements are arranged in pairs facing each other with their beam axes parallel to the axis of the strip and their reflectors between them. The reflectors are arranged to emit light in two predetermined directions relative to the axis, preferably along the floor to illuminate it, and vertically to mark the path to escaping occupants. In another embodiment the elements are arranged in a single direction and can have metal reflectors mounted on the elements. If the strip is mounted at the juncture of a wall and the floor, the reflectors angle alternate beams horizontally and outward at a 45° angle.

29 Claims, 2 Drawing Sheets

FIG 1
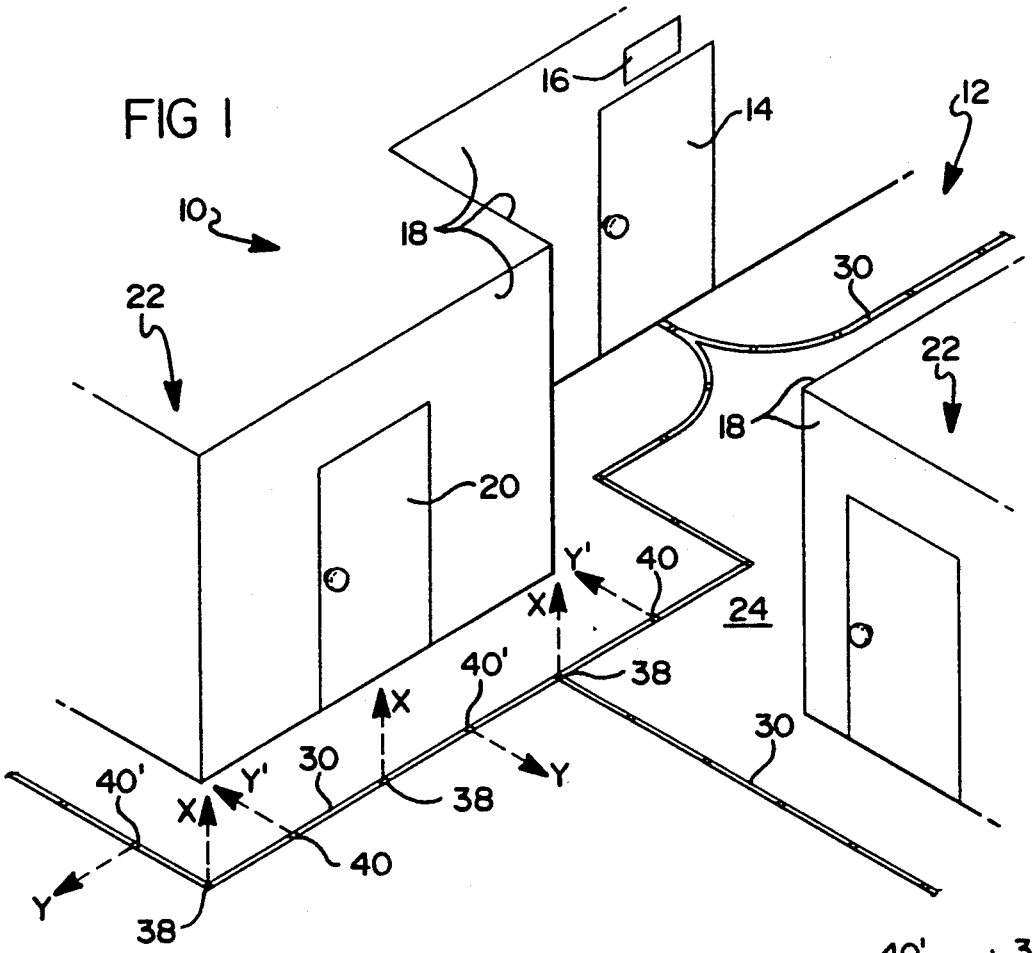
FIG 2
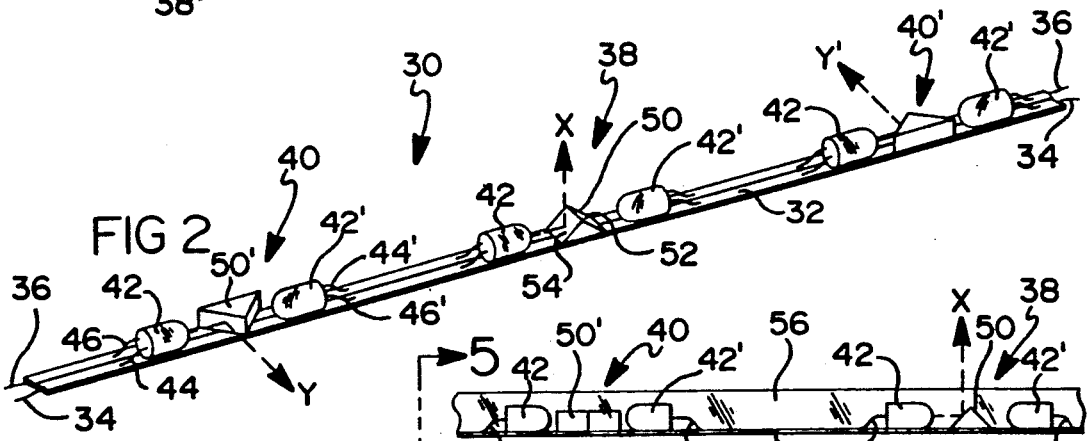
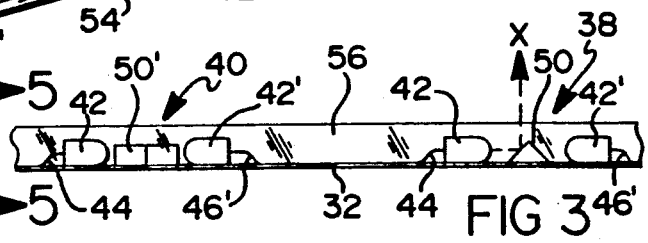
FIG 3
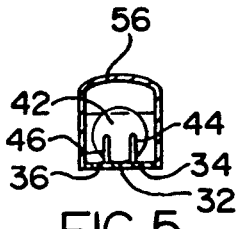
FIG 5
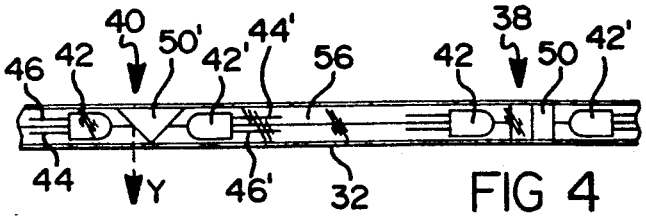
FIG 4

FIG 6
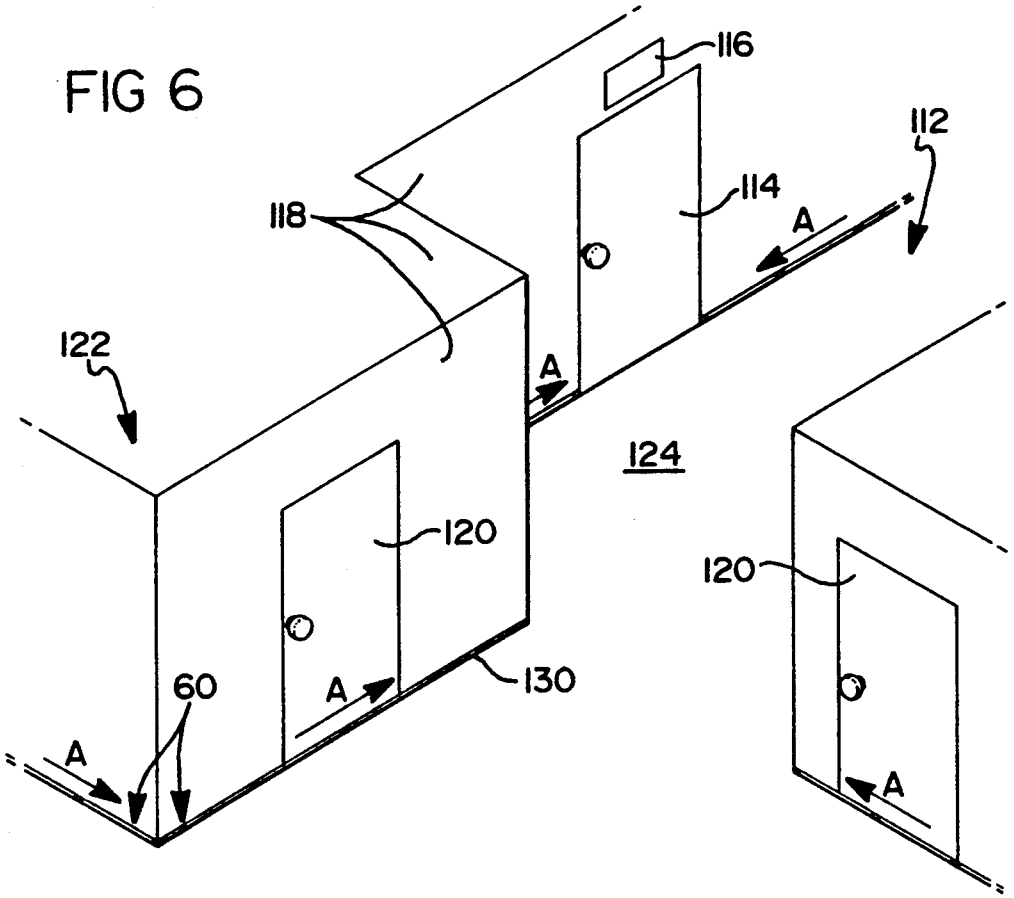
FIG 7
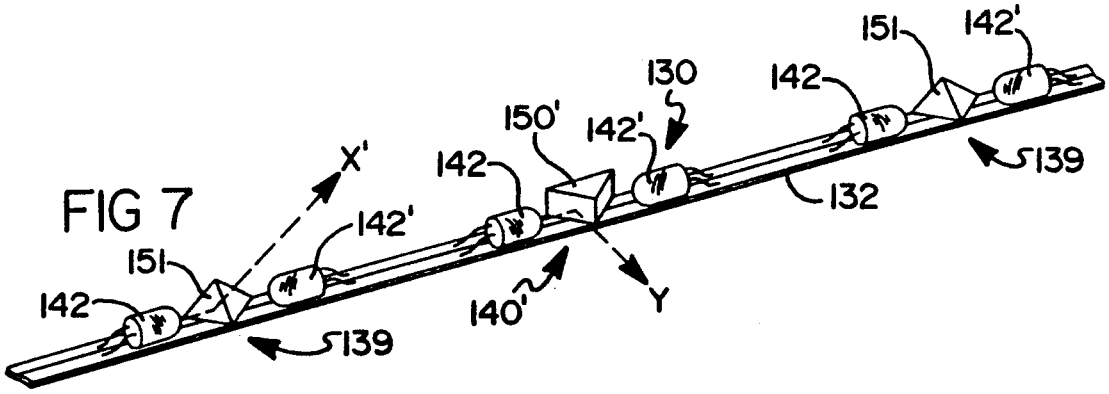
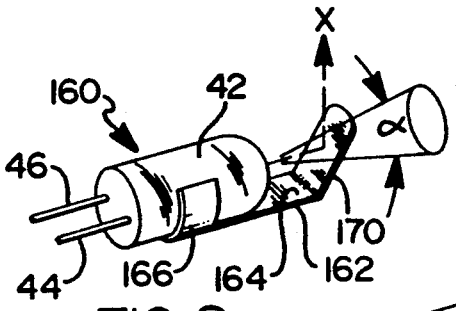
FIG 8
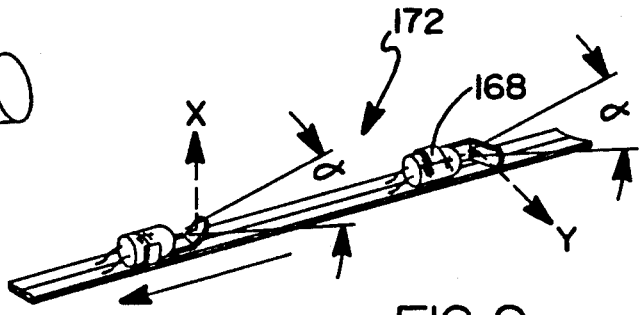
FIG 9

EMERGENCY LIGHTING STRIP

FIELD OF THE INVENTION

This invention relates generally to emergency lighting and, more particularly, to an emergency lighting aid for guiding the egress of occupants from a confined area during conditions of severely reduced visibility.

BACKGROUND OF THE INVENTION

Many different types of lighting aids and systems have been devised and used to provide emergency lighting for use when conditions render normal ambient lighting insufficient for visibility. Such conditions include power outages, smoke caused by fires, water immersion, and chemical fog.

One such system operable upon aircraft water immersion is disclosed in U.S. Pat. No. 4,597,033 to Meggs et al and assigned to the assignee herein. This system utilizes light emitting diodes (L.E.D.s) to form a strip which illuminates the outline of an egress hatch in a helicopter when it is submerged in water and is effective in conditions of considerable turbidity.

Another system, shown in U.S. Pat. No. 4,682,147 to Bowman, utilizes a plurality of L.E.D.s in an "EXIT" sign. The sign is illuminated during power failure to indicate a means of egress to confined occupants.

"EXIT" signs are a common sight in theaters, office buildings, stores, subways and other confining structures frequented by the public. Such signs are commonly illuminated by conventional incandescent light bulbs or, as illustrated in the Bowman patent, by L.E.D.s. The light sources in these signs emit their light spherically or hemispherically. Adequacy of these signs is frequently measured by their brightness, which is often equated to their visibility under emergency conditions.

However, this brightness standard is now being questioned, since, under conditions of visibility impaired by the presence of smoke or fog, this brightness can become a handicap. This is caused by diffusion of the light by the particles comprising the smoke or fog. As the distance between the observer and the lighted sign increases, the distinctness of the letters, then the sign itself, rapidly diminishes until only a general glow is distinguishable, which does not indicate the emergency exit that is the source of the light.

Also, as distance from the sign increases, the light scattered by the particulate matter, the light source becomes indistinguishable from the scattered light. Thus, the light source is no longer discernable at all. Unfortunately, a significant increase in light intensity increases the range of visibility only slightly. Thus, a very bright conventional sign becomes useless at a very short distance from it in dense smoke conditions which severely limits visibility.

Light strips are now being provided along aisles of airplanes to mark an emergency egress route. These comprise spaced light sources that suffer the same general visibility problems as the signs, being subject to rapid light diffusion in smoke. These light strips improve over signs, since they provide a light source that is closer to aircraft occupants by extending the length of the aisle.

However, in dense smoke conditions, the lighted strip rapidly visually disappears as viewing distance increases and transitions through a series of glowing pinpoints of light until only one pinpoint is visible at a time.

If only a single light pinpoint is discernable to an occupant, the location of the next pinpoint of light can only be guessed and the strip of light loses its primary function of marking a path to an emergency exit.

There is a need for emergency lighting that better penetrates smoke and fog to provide a visible and discernable guide to occupant egress from a confined area during an emergency which is functional at distances much greater than present lighting systems.

SUMMARY OF THE INVENTION

It is an object of this invention to provide emergency lighting that provides a visible and discernable guide to occupant egress from a confined area during an emergency and is functional at distances much greater than present emergency lighting systems.

It is another object of this invention to provide emergency lighting which utilizes a plurality of intense, discrete point sources of light that combine to produce a lighted pathway of improved visibility in conditions of severely limited visibility.

In accordance with one aspect, this invention features an emergency lighting strip comprising a plurality of spaced light-emitting elements each being an intense point source of light emitting a beam having an axial intensity of at least 0.12 candela and a full cone angle no greater than 24 degrees.

In accordance with another aspect, this invention features an emergency lighting strip comprising a plurality of spaced light-emitting elements, each being an intense point source of light emitting light along a beam axis and within a predetermined cone angle, and an external reflector located along the beam axis of each element and angled with respect thereto for deflecting the emitted light at a predetermined angle.

In accordance with yet another aspect, this invention features a lighting element for use in an emergency lighting aid for guiding the escape of occupants from a confined area during conditions of severely reduced visibility, comprising a body, a lens, a point source of light within the body for emitting a beam through the lens having an axial intensity of at least 0.12 candela and a full cone angle no greater than 24 degrees, and a reflector carried by the body for deflecting the emitted beam at a predetermined angle to the beam axis. The point sources of light are preferably L.E.D.s.

In accordance with a further aspect, this invention features a lighting element for use in an emergency lighting aid for guiding the escape of occupants from a confined area during conditions of severely reduced visibility, comprising a body, a lens, a point source of light within the body for emitting a beam through the lens, and a reflector carried by the body for deflecting the emitted beam at a predetermined angle to the beam axis. Preferably, the reflector includes a mounting portion for embracing the body and a reflecting portion projecting into the path of the beam at a predetermined angle to the beam axis, the reflecting portion being adjustable throughout a range of positions corresponding to a range of angles to the beam axis.

BRIEF DESCRIPTION OF THE DRAWINGS

FIG. 1 is a perspective view of a portion of a building incorporating one form of emergency lighting strip according to this invention;

FIG. 2 is a perspective view of a portion of the emergency lighting strip of FIG. 1;

FIG. 3 is a side view of the emergency lighting strip of FIG. 2;

FIG. 4 is a plan view of the emergency lighting strip of FIG. 2;

FIG. 5 is a sectional view of the emergency lighting strip, taken along line 5—5 of FIG. 3;

FIG. 6 is a view similar to FIG. 1, but incorporating another form of emergency lighting strip according to this invention;

FIG. 7 is a perspective view of a portion of the emergency lighting strip of FIG. 5;

FIG. 8 is an enlarged perspective view of an L.E.D. element used in the emergency lighting strips of this invention, illustrating the use of an alternative form of reflector; and FIG. 9 is a view similar to FIG. 2, but illustrating another embodiment of this invention which utilizes light elements of the type illustrated in FIG. 8.

DETAILED DESCRIPTION OF A PREFERRED EMBODIMENT

Referring now to FIGS. 1–4 of the drawings, a structure 10, such as an office building, includes a hallway 12 that leads from an exterior-access exit door 14, so identified by a conventional "EXIT" sign 16. Sign 16 is of conventional illuminated construction normally mandated by local fire codes to denote door 14 as a means of emergency egress from building 10. The hallway 12 is defined by interior walls 18, which mount doors 20 leading to interior conventional offices 22, and floors 24. As illustrated here, the only access exteriorly of the building 10 available to occupants is through exit door 14.

Large structures, such as office buildings and hotels often contain a "maze" of corridors and hallways that are easily traversed only by frequent occupants who have memorized their layout. Occasional occupants and visitors (or guests in the case of a hotel) can normally find their way only with the help of unlighted instructional signs. As mandated by local fire codes, illuminated "EXIT" signs are provided at ceiling level and at intervals to indicate an emergency egress path. However, these signs are actually of limited utility in the case of a fire that generates significant smoke, as is the usual case.

These illuminated signs rapidly become all but invisible at any appreciable distance. This occurs because the signs are usually backlit and thus emit light hemispherically. As the photons of this emitted light encounter the particulate matter comprising the smoke, they are randomly scattered and absorbed. Since the smoke is densest near the ceiling where the signs are located, visibility of the signs rapidly decreases. Thus, it is all too probable that building occupants would be unable to discern these "EXIT" signs and could wander aimlessly through the maze of unfamiliar hallways in search of an exit from the building and its fire.

As the smoke thickens, occupants would move nearer the floor 24 where the smoke is least dense and where the supply of oxygen is greatest. This would, however move the occupants even further from overhead "EXIT" signs. Even if the occupants would crawl close to door 14, sign 16 would probably be obscured from view. To enhance the occupants' ability to quickly locate and utilize an escape route in the case of fire, this invention provides emergency lighting strip 30.

Emergency lighting strip 30 is embedded in the carpeting or other covering for the floor 24 of hallway 12. In the embodiment of FIG. 1, strip 30 is preferably located centrally of floor 24 and leads directly to door 14. As shown in FIGS. 2–4, lighting strip 30 comprises a mounting or base strip 32 which carries electrical conductors 34, 36. Strip 30 includes a plurality of vertical light emitting units 38 and horizontal light emitting units 40, 40′ which contain L.E.D. elements 42, 42′. The elements 42 and 42′ are identical in construction, but face in different directions along strip 30 and are preferably spaced at intervals of from 4″–26″ along the strip axis.

These L.E.D. elements 42 and 42′ include respective leads 44, 46 and 44′, 46′ that are connected to conductors 34, 36 and are mounted so that their beam axes are parallel to the length of strip 30. The L.E.D.s preferably have a cone angle of no greater than about 24° and an intensity of at least 0.12 candela. Each opposing pair of L.E.D.s 42 and 42′ in the vertical light emitting units 38 is separated by a prism 50 having 45° reflective faces 52, 54. Prisms 50 are oriented on strip 30 to reflect the emitted beams from L.E.D.s 42, 42′ vertically, as indicated by the arrow X in FIGS. 2 and 3.

Similarly, L.E.D.s 42, 42′ in the horizontal light emitting units 40 are separated by prisms 50′ having 45° reflective faces 52′, 54′. Prisms 50′ in light unit 40 are identical to prisms 50, but are oriented on strip 30 to reflect the emitted beams horizontally, to the sides of strip 30, as indicated by the arrow Y in FIGS. 2 and 4.

As shown in FIG. 1, alternate horizontal light emitting units 40′ are identical to units 40, except that their prisms 50′ are reversed to direct the L.E.D. beams in direction Y′ to the other side of strip 30. As shown in FIGS. 3–5, a U-shaped protective translucent plastic cover 56 is fitted over strip 30.

In an emergency, when the building is smoke-filled, a building occupant in hallway 12 will be able to peer directly down and see the light beams X emitted from L.E.D.s 42, 42′ and directed upwardly by prisms 50. The occupant can then move to the strip 30. When standing over strip 30, light from beams emitted by all adjacent L.E.D.s 42 whose cone angles encompass the occupant will be visible in one direction, insofar as smoke density will permit. Similarly, L.E.D.s 42′ will be visible in the other direction. By following the intermittent light beams, the occupant will be able to safely traverse the maze of smokefilled hallways 12 to exit door 14.

Should smoke conditions force the occupant to a crawling position near the floor, light beams X will not be visible; instead, either of the side-directed beams Y or Y′ will be visible. The occupant can then crawl to strip 30, whereupon the L.E.D.s 42 will be visible in one direction and L.E.D.s 42′ will be visible in the other direction. The occupant can then follow strip 30 to exit door 14.

When the occupant is in a crawling position near the floor and sights along the strip 30, all L.E.D.s facing in one direction (i.e. all L.E.D.s 42 or 42′) will be visible end-on (smoke conditions permitting) since the reflectors 50 or 50′ do not intercept and reflect the entire emitted beam. This means that the occupant (if within the cone angle) will be able to view all the L.E.D. chips directly at their brightest.

Thus, an occupant in a crawling position (recommended for evacuation from smoke-filled buildings) will see a diminishing succession of bright spots which form the strip. Of course the number of bright spots visible will depend on the spacing and brightness of the L.E.D.s and the visibility conditions.

In one recent test with a strip comprising L.E.D.s of 0.12 candelas and a 24° cone angle at a 26" spacing in the FIG. 2 configuration, in conditions of dense, white smoke (0.5 per foot specific optical density), I was able to see vertical and horizontal reflected light beams (X and Y in FIGS. 1 and 2) at a visibility threshold distance of 6.0'. In contrast, while in a crawling position viewing the L.E.D.s end-on, I could see the elements at 8.75'. I note that the X and Y beams comprised the closely spaced reflected beams from two L.E.D.s (an opposed pair 42, 42'), while the end-on view was from only single L.E.D.s (either 42, or 42'). Thus, the strip 30 performs as an escape aid best when the building occupant is in the recommended crawling position.

Another embodiment of this invention is illustrated in FIGS. 6 and 7. In this embodiment, elements similar to those in the FIGS. 1-5 embodiment are indicated by like numerals increased by 100; thus a strip light 130 is provided in hallway 112 at the intersection of floor 124 and walls 118. This enables use of an emergency light strip 130 that requires no modification to imbed it in the carpeting.

As seen in FIG. 7, strip 130 is shown with its translucent plastic cover removed. Light units 139 are alternated with light units 140'. Units 140' have prisms 150' that project the light from opposed L.E.D.s 142, 142' horizontally in direction Y. Light units 151 include modified prisms which direct light from their L.E.D.s 142, 142' outwardly at a 45° angle to both the floor and wall as indicated by arrow X'. With this arrangement, an occupant traversing hall 112 at its center will see light emanating from the units 139, while someone crawling will see light from units 140'.

Another embodiment of light unit is shown in FIGS. 8 and 9. Light unit 160 comprises an L.E.D. 42 as above. Instead of the separate prism reflectors used in the FIGS. 2-5 and 7-8 embodiments, L.E.D. 42 is provided with an individual reflector 162 comprising a unitary piece of formed reflective metal.

Reflector 162 includes a main segment 164 that mounts a pair of arcuate arms 166, 168 which grasp L.E.D. 42 to secure the reflector thereto. The reflector 162 further includes an angled reflector portion 170 that is an angled extension of main segment 164. The angle of reflector portion 170 is illustrated at 45° to provide the vertical light beam X.

As shown in FIG. 9, alternate light units 160 can have alternate orientations on a lighting strip 172 to provide the alternate beams X and Y. The light units 160 are illustrated as all facing the same direction, thus making light strip 172 directional. In this instance, a building occupant traversing hallway 112 which incorporates light strip 172 will see only light from a series of L.E.D.s in one direction, as indicated by arrows A. This will force the occupant to move toward exit door 114.

The light units 160 are advantageous in that the reflectors 162 can be rotated about the L.E.D.s and the reflector portions 170 can be bent to project the emitted beam at any desired angle, without requiring added elements. The units 106 can also be used in opposed pairs, as in the FIGS. 2-5 embodiment to provide a nondirectional light strip.

FIGS. 8 and 9 also illustrate that the light beam emitted from the L.E.D.s 42 has a cone angle $\alpha$, which in this case is preferably 24° or less. These figures illustrate that the reflector, in this case reflector portion 170, does not reflect the entire emitted beam, but allows a portion of it to bypass. This enables light to be seen further down the light strip for the purposes described above. The amounts of light reflected and bypassed for a given cone angle can be modified for differing conditions by varying the size and spacing of the reflector from the L.E.D.

While only preferred and alternative embodiments have been illustrated and described, obvious modifications are contemplated within the scope of this invention and the following claims. For example, the reflector surface could be modified into a conical shape, while the reflector surface could be modified to a matte or other finish to modify the beam emanating from the L.E.D.

I claim:

1. An emergency lighting strip comprising a plurality of light-emitting elements spaced along the strip axis, each being an intense point source of light emitting a beam along its beam axis having an axial intensity of at least 0.12 candela and a full cone angle no greater than 24 degrees.

2. The emergency lighting strip of claim 1, wherein each element includes an external reflector located along its beam axis and angled with respect thereto for deflecting the emitted light at a predetermined angle.

3. The emergency lighting strip of claim 2, wherein the strip comprises elements arranged with their beam axes parallel to the axis of the strip.

4. The emergency lighting strip of claim 3, wherein the reflectors are arranged to emit light in at least two directions relative to the strip axis.

5. The emergency lighting strip of claim 3, wherein the elements are arranged with their reflectors so positioned to provide light beamed in said directions, and yet enable the observation of light from each element, at a point spaced from the strip axis but within the beam cone angle of the element, thus enabling simultaneous observation of multiple light elements at a single observation point.

6. The emergency lighting strip of claim 4, wherein the elements are arranged with their reflectors so positioned to provide light beamed in said directions, and yet enable the observation of light from each element, at a point spaced from the strip axis but within the beam cone angle of the element, thus enabling simultaneous observation of multiple light elements at a single observation point.

7. An emergency lighting strip comprising a plurality of light-emitting elements, spaced along the strip axis, each being an intense point source of light emitting light along a beam axis and within a predetermined cone angle, and an external reflector located along the beam axis of each element and angled with respect thereto for deflecting the emitted light at a predetermined angle.

8. The emergency lighting strip of claim 7, wherein the strip comprises elements arranged with their beam axes parallel to the axis of the strip.

9. The emergency lighting strip of claim 8, wherein the reflectors are arranged to emit light in two predetermined directions relative to the strip axis.

10. The emergency lighting strip of claim 9, wherein the elements are arranged with their reflectors so positioned to provide light beamed in said directions, and yet enable the observation of light from each element, at a point spaced from the strip axis but within the beam cone angle of the element, thus enabling simultaneous observation of multiple light elements at a single observation point.

11. The emergency lighting strip of claim 7, wherein the elements are arranged in pairs spaced along the strip, with the paired elements emitting light toward each other and with the reflectors interposed between the elements and arranged to deflect the emitted beams in the same direction, thus doubling the intensity of light so emitted.

12. The emergency lighting strip of claim 9, wherein the elements are arranged in pairs spaced along the strip, with the paired elements emitting light toward each other and with the reflectors interposed between the elements and arranged to deflect the emitted beams in different directions, so that each pair of elements emits light in both predetermined directions.

13. The emergency lighting strip of claim 7, wherein each element emits a beam having an axial intensity of at least 0.12 candela.

14. The emergency lighting strip of claim 11, wherein the emitted beam has a full cone angle no greater than 24 degrees.

15. An emergency aid for guiding the escape of occupants from a confined area during conditions of severely reduced visibility, comprising a lighting strip arranged along a predetermined escape route and having a plurality of L.E.D. elements spaced along the strip axis, wherein each element is an intense point source of light emitting a beam having an axial intensity of at least 0.12 candela and a full cone angle no greater than 24 degrees, and includes an external reflector located along its beam axis and angled with respect thereto for deflecting the emitted light at a predetermined angle.

16. The emergency aid of claim 15, wherein the lighting strip is mounted on the floor of the predetermined escape route.

17. The emergency aid of claim 16, wherein the strip comprises elements arranged with their beam axes parallel to the axis of the strip.

18. The emergency lighting strip of claim 17, wherein the reflectors are arranged to emit light in two predetermined directions relative to the strip axis.

19. The emergency lighting strip of claim 18, wherein one of the directions is substantially along the floor, and the other of which is substantially perpendicular to the floor.

20. The emergency lighting strip of claim 18, wherein the elements are arranged with their reflectors so positioned to provide light beamed in said directions, and yet enable the observation of light from each element, at a point spaced from the strip axis but within the beam cone angle of the element, thus enabling simultaneous observation of multiple light elements at a single observation point.

21. The emergency lighting strip of claim 18, wherein the elements are arranged in pairs spaced along the strip, with the paired elements emitting light toward each other and with the reflectors interposed between the elements and arranged to deflect the emitted beams in the same direction, thus doubling the intensity of light so emitted.

22. The emergency lighting strip of claim 18, wherein the elements are arranged in pairs spaced along the strip, with the paired elements emitting light toward each other and with the reflectors interposed between the elements and arranged to deflect the emitted beams in different directions, so that each pair of elements emits light in both predetermined directions.

23. A lighting element for use in an emergency lighting aid for guiding the escape of occupants from a confined area during conditions of severely reduced visibility, comprising a body, a lens, a point source of light within the body for emitting a beam through the lens along a beam axis within a predetermined cone angle, and a reflector carried by the body for deflecting the emitted beam at a predetermined angle to the beam axis.

24. The lighting element of claim 23, wherein the reflector includes a mounting portion for embracing the body and a reflecting portion projecting into the path of the beam at a predetermined angle to the beam axis.

25. The lighting element of claim 24, wherein the reflecting portion is adjustable throughout a range of positions corresponding to a range of angles to the beam axis.

26. The lighting element of claim 25, wherein the reflector is a unitary piece of metal.

27. The lighting element of claim 25, wherein the reflecting portion is made of aluminum and is manually bendable throughout the range of angles.

28. The lighting element of claim 23, wherein the point source of light is an L.E.D.

29. The lighting element of claim 23, wherein the point source of light has an axial intensity of at least 0.12 candela and a full cone angle no greater than 24 degrees.

* * * * *